US005315720A

United States Patent [19]

Lior

[11] Patent Number: 5,315,720

[45] Date of Patent: May 31, 1994

[54] HIGH FLOW, LOW TURBULANCE SWIM-IN-PLACE POOL

[76] Inventor: David Lior, 1 Mohliver Street, Herzelia 46328, Israel

[21] Appl. No.: 25,836

[22] Filed: Mar. 3, 1993

[51] Int. Cl.[5] ..... E04H 3/18

[52] U.S. Cl. ..... 4/488; 4/904; 417/320

[58] Field of Search ..... 4/488, 489, 491, 496, 4/492; 405/79, 83, 99, 106; 417/320

[56] References Cited

U.S. PATENT DOCUMENTS

| | | | |
|---|---|---|---|
| 722,232 | 3/1903 | Hoeglauer | 4/541.1 |
| 1,002,472 | 9/1911 | Thompson et al. | 417/320 |
| 1,331,270 | 2/1920 | Lippincott | 4/496 X |
| 1,731,554 | 10/1929 | Wheeler | 4/496 X |
| 2,415,592 | 2/1947 | Hoenecke | 417/320 |
| 3,783,623 | 1/1974 | Ogden | 405/83 |
| 3,802,697 | 4/1974 | LeMehaute | 4/491 X |
| 3,913,332 | 10/1975 | Forsman | 4/491 X |
| 4,845,787 | 7/1989 | Lior | 4/488 |

*Primary Examiner*—Charles E. Phillips
*Attorney, Agent, or Firm*—Gene W. Arant

[57] ABSTRACT

A swim-in-place pool has horizontal inner and outer circulating waterways arranged in such manner that a portion of the inner waterway coincides with a portion of the outer waterway. The non-coincident portion of the inner waterway then provides a swimming space. A plurality of impeller blades are suspended in a spaced series within the coinciding portion of the two waterways, each of the blades in its operative condition extending transversely of that waterway and occupying substantially all of its cross-sectional area. A power drive advances the blades in unison along the coinciding portion of the two waterways so that a rather fixed body of water is captured between each two adjacent blades and advanced therewith. A diversion structure adjacent the entry of the non-coincident portion of the inner waterway diverts a continuous flow of water in a relatively non-turbulent state into and through the swimming space.

6 Claims, 3 Drawing Sheets

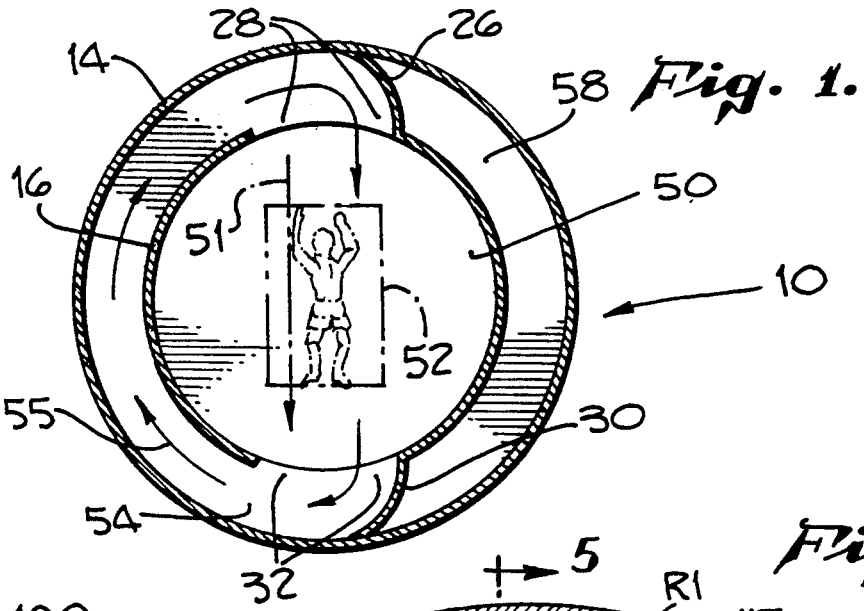
Fig. 1.
Fig. 2.
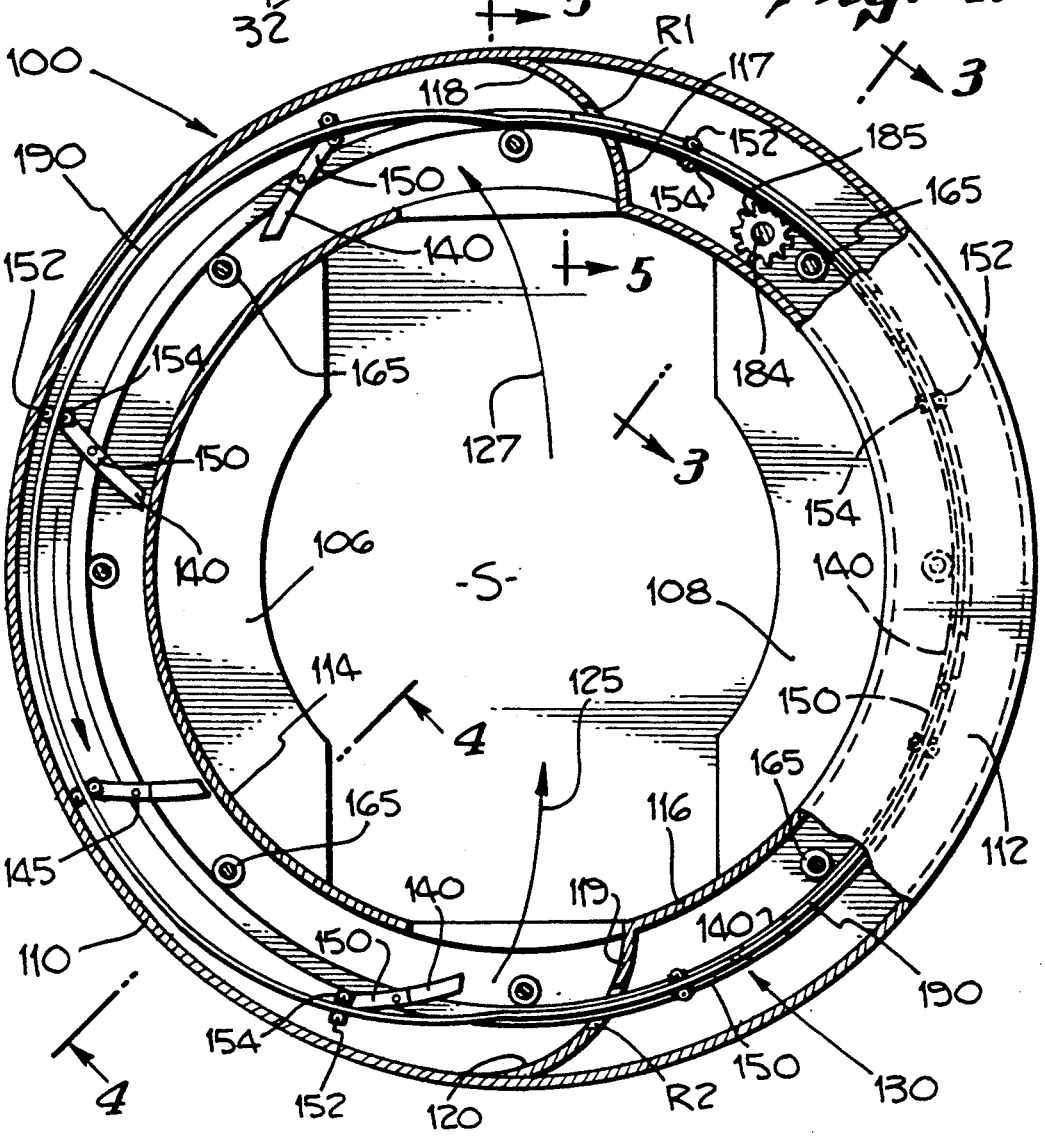

HIGH FLOW, LOW TURBULANCE SWIM-IN-PLACE POOL

INCORPORATION BY REFERENCE

In order to avoid needless repetition of subject matter, the entire disclosure of my issued U.S. Pat. No. 4,845,787 is incorporated herein by reference, in accordance with the practice authorized by the Manual of Patent Examining Procedure, Section *608,01(p).

SUMMARY OF THE INVENTION

According to the invention, a swim-in-place pool comprises horizontal inner and outer circulating waterways, arranged in such manner that a portion of the inner waterway coincides with a portion of the outer waterway. The non-coincident portion of the inner waterway then provides a swimming space through which water flows continuously in a relatively non-turbulent state. A series of impeller blades are suspended within the outer waterway, each of the blades normally extending transversely of the outer waterway and occupying substantially all of its cross-sectional area. Powered means is provided for advancing the blades in unison along the coinciding portion of the two waterways so that a substantially fixed body of water is captured between each two adjacent blades and advanced therewith. Adjacent the entry of the swimming space, means are provided for diverting water from the coinciding portion of the two waterways into the swimming space.

DRAWING SUMMARY

FIG. 1 is a top plan view schematically illustrating the structure and operation of the invention as disclosed in my above-referenced U.S. Pat. No. 4,845,747 and is identical to FIG. 10 of that patent;

FIG. 2 is a top plan view, partially in cross-section, of the presently improved form of my invention;

BRIEF SUMMARY OF PRIOR PATENT

Figure 4:
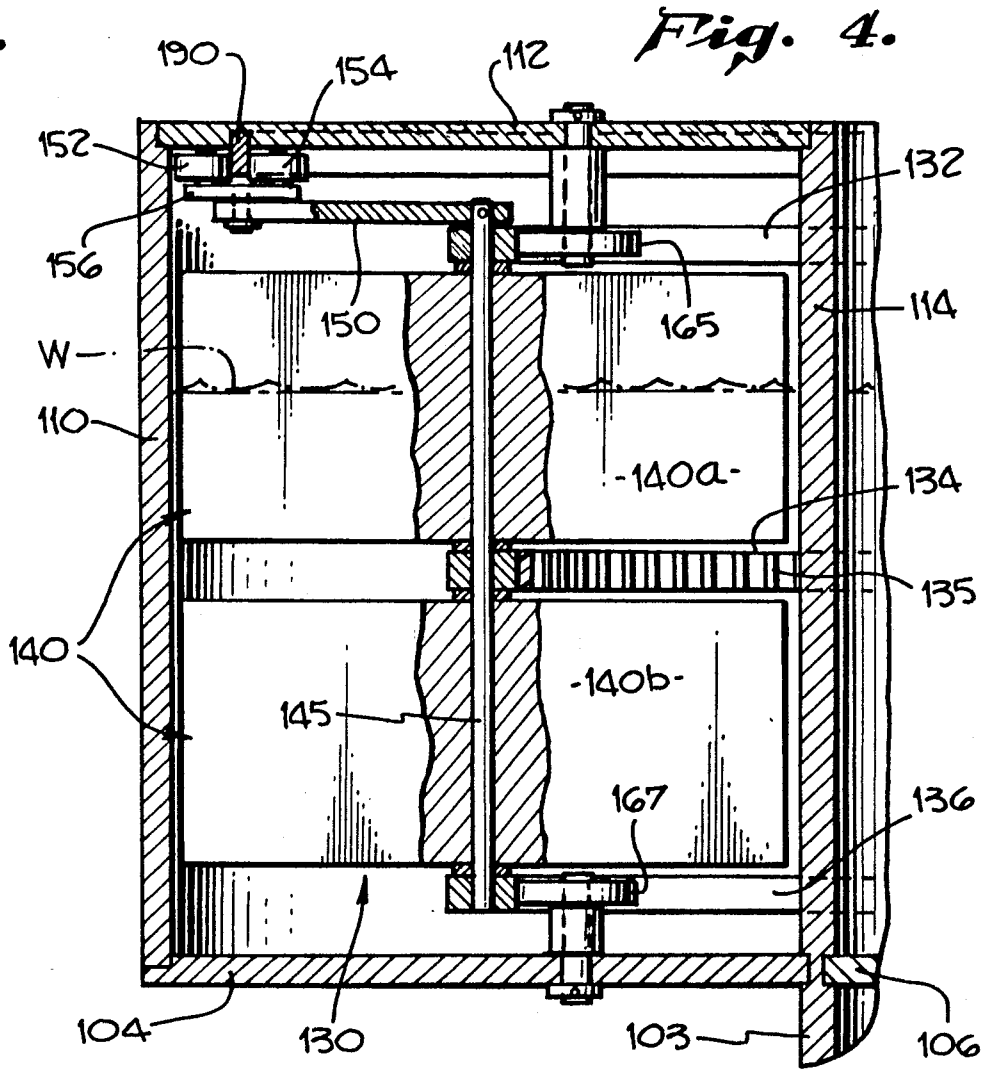
FIG. 4 is a vertical cross-section view taken on the line 4—4 of FIG. 2.

Reference is now made to FIG. 1 of the drawings which schematically illustrates the invention as disclosed in my previous patent referred to above.

As shown in FIG. 1, a circular housing 10 has a circular outer wall 14 and a concentric inner wall 16. At one point on the circumference of the housing 10 (at its top as shown in FIG. 1) a diverter wall 26 extends between walls 14 and 16, and opposite the diverter wall 26 the inner wall 16 has an opening 28. At an opposite point on the housing circumference (its bottom as seen in FIG. 1) there is another diverter wall 30 which extends between outer wall 14 and inner wall 16. Opposite the diverter wall 30 the inner wall 16 has an opening 32.

As shown schematically in FIG. 1, the entire space inside the inner wall 16 is designated by numeral 50, and it is filled with water. That portion of space 50 which lies directly between the openings 28 and 32 is designated as a swimming space 52 indicated by dotted lines, and is shown as being occupied by a swimmer.

The space between walls 14 and 16 which communicates with the openings 28 and 32 is designated by numeral 54, and provides a return and propulsion passageway for water flowing through the swimming space. FIG. 1 shows the swimmer headed toward opening 28, and arrow 51 shows the water flowing from opening 28 toward the swimmer and thence into opening 32.

For convenient reference the opening 28 or its equivalent is referred to as the water inlet opening, while opening 32 or equivalent is identified as the water outlet opening. Thus the terms "inlet" and "outlet" are used with reference to the water flow that takes place inside the swimming space 50. It will therefore be seen that within the propulsion and return passageway 54 the direction of water flow as shown by arrow 55 is from outlet opening 32 to inlet opening 28.

There is another space between walls 14 and 16 on the closed side of diverter walls 26 and 30 which is designated by the numeral 58. This space would not necessarily be occupied by water, but preferably is, in order to provide a circulating path for the water advancing means. When the space 58 is filled with water there are inner and outer horizontal circulating waterways having a coinciding portion, and the non-coincident portion of the inner waterway provides a swimming space.

DESCRIPTION OF THE PRESENTLY IMPROVED FORM OF THE INVENTION (FIGS. 2 through 6)

The illustrated apparatus includes, in general, a tank structure 100, a drive ring structure 130, a guide mechanism for the drive ring structure, and a power drive means. These main components of the apparatus will first be described separately in some detail. Thereafter, the significant cooperative action between them will be described.

Figure 3:
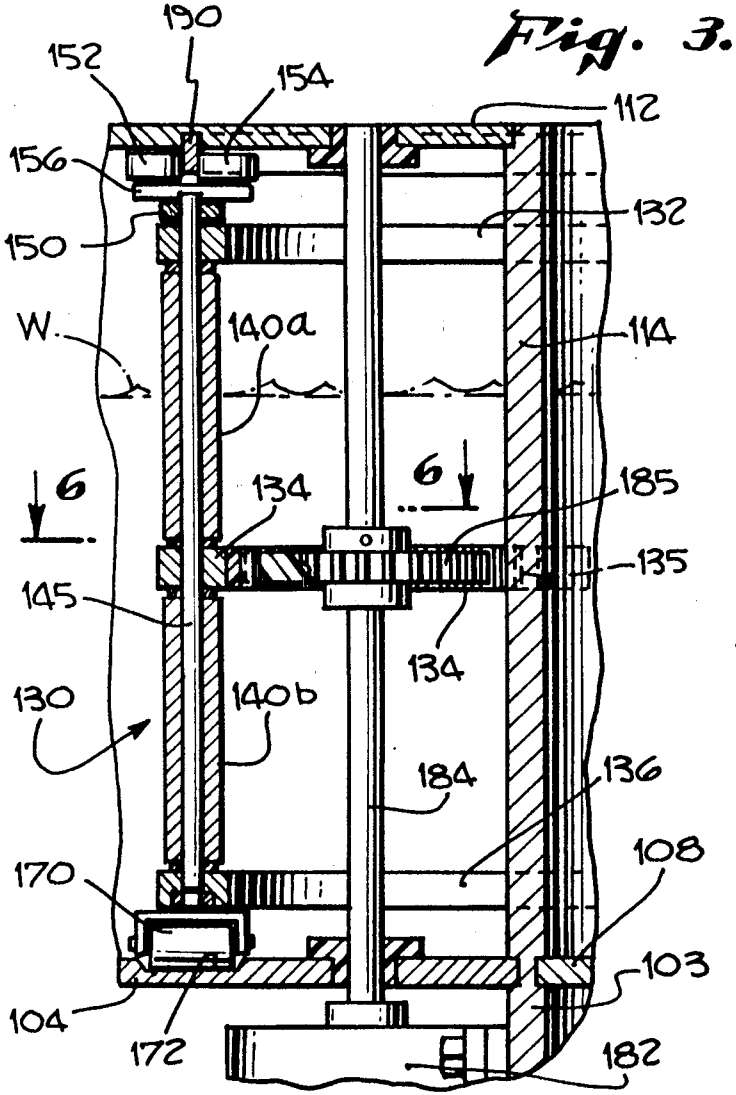
FIG. 3 is a vertical cross-section view taken on the line 3—3 of FIG. 2.
Figure 5:
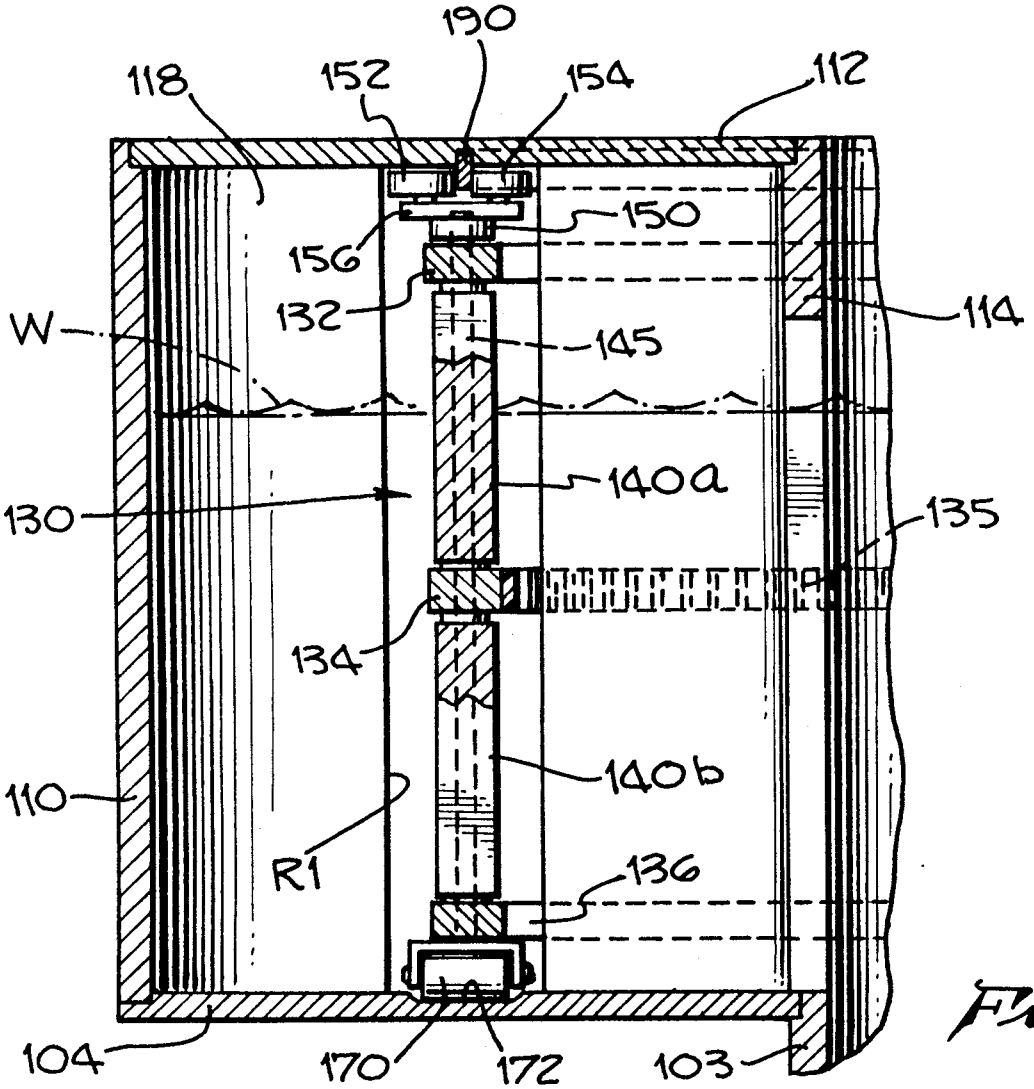
FIG. 5 is a vertical cross-section view taken on the line 5—5 of FIG. 2.

Tank structure 100 includes a relatively deep central portion having a flat circular inner bottom wall 102 (FIG. 2), and a surrounding annular portion having an elevated outer bottom wall 104 (FIGS. 3–5). Within the central portion of the tank a pair of side seats 106, 108, (FIGS. 2, 3 and 4) are at the same elevation as bottom wall 104 of the surrounding annular portion of the tank. Below the side seats 106, 108, an outer cylindrical wall 103 surrounds circular bottom wall 102.

The annular outer portion of tank structure 100 has an outer wall 110 (FIGS. 2, 4, 5) and a flat top wall 112 (FIGS. 3–5). It also has inner wall sections 114, 116 which are concentric to the outer wall 110 (FIG. 2). Wall sections 114 and 116 constitute discrete portions of a cylinder. As best seen in FIG. 5, the entire annular space above bottom wall 104 is filled with water W. An arrow 125 in FIG. 2 shows water flowing from the annular space between walls 110 and 114 into a swimming space S which is provided in the central and deeper portion of tank structure 100 above its bottom wall 102, while an arrow 127 shows water leaving the swimming space to return to the water return and propulsion channel that is formed between wall section 114 and the outer wall 110. Wall section 114 does not in and of itself include any diverter structure.

Wall section 116 does have diversion structures associated with both of its ends (FIG. 2). At the upper or water outlet end as seen in FIG. 2, the wall section 116 has a short curved extension 117, followed by a radial space R1, and then a partial diverter wall 118 that is attached to the inner surface of outer wall 110. As will later be seen, the radial space R1 between diverter wall sections 117, 118 is essential to the passage of impeller blades when in their non-operative (longitudinally aligned) state. At the lower or water inlet end as seen in FIG. 2, the wall section 116 has a short curved extension 119, followed by a radial space R2, and then a partial diverter wall 120 that is attached to the inner surface of outer wall 110. The radial space R2 between diverter wall sections 119, 120 is also essential to the passage of impeller blades.

Drive ring structure 130 (FIGS. 2 and 3) includes a top ring 132, a middle ring 134, and a bottom ring 136. The middle ring 134 is toothed on its inner surface around its entire circumference, but the top and bottom rings 132, 136, have no teeth. The drive ring structure 130 carries a plurality of at least three impeller blades 140, actually numbering eight in the present embodiment. Each impeller blade 140 has an upper half **140*a* and a lower half 140*b* (FIG. 4). A vertical pin or shaft 145 extends vertically through the centers of both the top and bottom halves of each of the blades 140, and also extends through each of the rings 132, 134, 136 (FIG. 3, also FIGS. 4 and 5). These pins that support the impeller blades also assist in maintaining the structural integrity of the drive ring structure. The upper and lower halves of the blade 140 are fixedly attached to the associated shaft 145 so that they rotate in exact synchronism with it, but the shaft 145 itself is journalled in each of the drive rings 132, 134, 136**, so that it is able to rotate relative to all of those rings.

Above each impeller blade 140 there is a horizontally extending guide arm 150 whose inner end is fixedly attached to the top end of the associated shaft 145 (FIG. 4). The outer end of the guide arm 150 carries a spaced pair of guide rollers 152, 154, which are supported from the guide arm by means of a pivotal base member 156. As later explained, guide rollers 152, 154, serve a camming function for rotating the impeller blade either towards a position in which it is completely transverse to the water return and propulsion space between walls 100 and 114 (FIG. 4), or towards a position in which it is longitudinally aligned therein (FIG. 3).

The guide mechanism cannot easily be seen in the drawings as a separate entity. It includes a number of different guide rollers for maintaining the drive ring structure 130 in a position concentric to outer cylindrical wall 110. It includes top rollers 165 and bottom rollers 167 (FIG. 4). Each top roller 165 has an associated spacer for supporting it from top wall 112, and a pin or shaft for permitting it to rotate freely about a vertical axis. Each bottom roller 167 is supported in the same fashion from bottom wall 104. The rollers 165, 167, engage the smooth inner circumferential surfaces of the drive rings 132, 136, respectively, for keeping the drive ring structure 130 in a well supported and completely concentric position. In the illustrated embodiment there are eight sets of the rollers 165 and 167 (see FIG. 2).

The guide mechanism also includes a number of bottom rollers 170 (FIGS. 3, 5) for providing vertical support to the drive ring structure. These rollers are attached directly to the bottom surface of bottom ring 136 in a fixed position with their axes of rotation radial to the drive ring structure, and roll on the upper surface of the outer bottom wall 104. The circumferential groove 172 formed within that surface and shown in the drawings as receiving rollers 170 is preferred but not essential.

Figure 6:
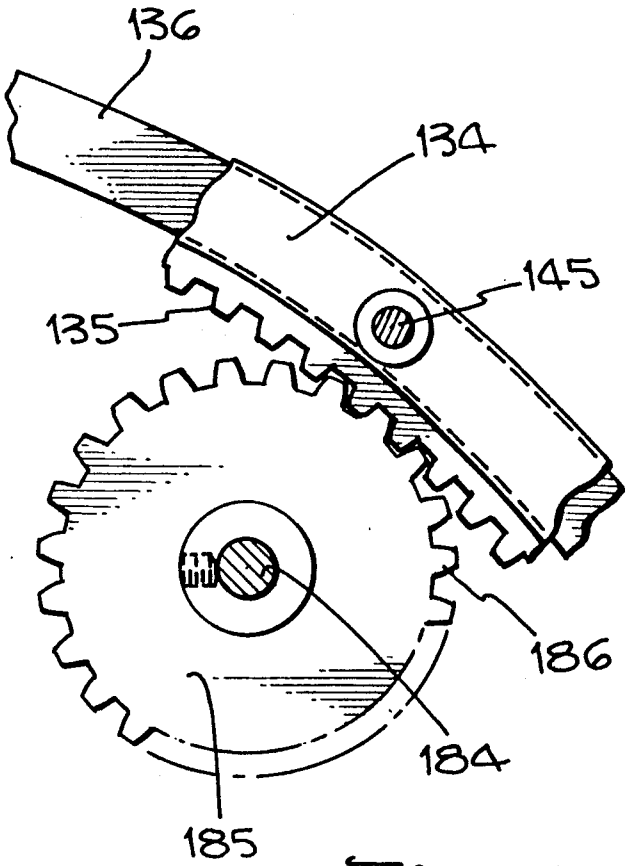
FIG. 6 is a fragmentary horizontal cross-section view taken on the line 6—6 of FIG. 3.

The power drive mechanism includes a motor 182 (FIG. 3) which is positioned beneath the outer bottom wall 104, having a shaft 184 which extends vertically upward and is journalled in both the bottom wall 104 and the top wall 112. Assuming that inner bottom wall 102 of the tank structure 100 rests upon a flat ground surface, the motor 182 is easily accessible for inspection, maintenance, and control, since the outer bottom wall 104 is located a substantial distance above the inner bottom wall 102. Shaft 184 carries a drive gear 185 Whose teeth 186 engage teeth 135 of the center drive ring 134 (FIG. 6).

A cam rail 190 extends about the entire circumference of top wall 112. The guide rollers 152, 154, associated with each impeller blade ride on opposite vertical surfaces of the cam rail. The function of the cam rail 190 and guide rollers 152, 154, is to guide each impeller blade, after it passes through space R1 between diverter wall sections 117, 118, into a water-advancing, transversely disposed, position, and then to reverse that action and align the blade longitudinally within the water return and propulsion passageway as the blade approaches radial space R2 between the diverter wall sections 119, 120.

OPERATION OF THE APPARATUS

In operation, the apparatus provides a swim-in-place pool which includes horizontal inner and outer circulating waterways arranged in such manner that a portion of the inner waterway coincides with a portion of the outer waterway, and the non-coincident portion of the inner waterway then provides a swimming space. The plurality of impeller blades 140 are suspended in a spaced series within the coinciding portion of the two waterways. Each of the blades in its operative position extends transversely of the coinciding waterway portion and occupies substantially all of its cross-sectional area. Powered means advances the blades in unison along the coinciding portion of the two waterways so that a substantially fixed body of water is captured between each two adjacent blades and advanced with the blades. A vertical diverter wall is provided adjacent the entry of the non-coincident portion of the inner waterway for diverting water therein from the coinciding portion of the two waterways. The diverter wall is curved in the horizontal plane to smoothly direct the water flowing along the coincident portion of the waterways so as to enter the swimming space S and thereby provide a continuous and relatively non-turbulent flow of water through the swimming space.

As a further feature of operation, each of the impeller blades is adjustable by rotation about a vertical axis. In addition, there is a cam means for rotating each impeller blade into its operative position after it has entered the water return and propulsion passageway through space R1, and then into essentially a position of longitudinal alignment with the passageway to permit its exit passage through the radial space R2 between wall sections 119, 120.

More specifically, the water diverting means includes the diversion wall sections 117, 118, 119, 120, the radial space or slot R1 between sections 117, 118, and the radial space or slot R2 between wall sections 119, 120.

The invention has been described in complete detail in one of its embodiments in order to fulfill the requirements of the patent laws, but it will be understood that the scope of the invention is to be measured only by the appended claims.

What is claimed is:

1. In a fluid pump in which a plurality of blades arranged in sequence are propelled around a closed-loop path for drawing fluid into the path at an entrance location and then expelling it from the path at an exit location, each of said blades being pivotally mounted on a vertical axis, the improvment comprising:

means supporting each of said blades in a transversely extended position prior to its approach to said exit location, a smoothly curved diverter wall positioned at said exit location and extending transversely across said path so that each approaching blade propels fluid forwardly along said path and then directs it along said diverter wall so as to expel it from the exit, a vertical slot formed in said diverter wall near the lateral center of said path, and said supporting means also being operable for rotating each of said blades as it approaches said diverter wall into a position longitudinally aligned with said path so as to permit it to pass through said vertical slot.

2. A swim-in-place pool comprising a fluid pump as claimed in claim 1 wherein said closed-loop path occupies a horizontal plane, and which further includes means defining a swimming space that extends between said exit location and said entrance location in the same horizontal plane.

3. A swim-in-place pool as in claim 2 which includes a horizontally disposed annular water receptacle defining said closed-loop path, and wherein said swimming space lies along a diameter of said receptacle.

4. A swim-in-place pool as in claim 3 which includes a ring-shaped frame rotatable within said receptacle and supporting said impeller blades for propelling said blades along said path; and wherein said blade supporting means includes a camming structure associated with said ring-shaped frame.

5. A swim-in-place pool comprising:

horizontally disposed annular water receptacle;

a ring-shaped frame having at least three impeller blades supported in sequentially spaced positions thereon and each adjustable by rotation about a vertical axis, said impeller blades being adapted to extend into a body of water contained within said receptacle;

powered means for continuously rotating said frame so as to advance said impeller blades along a circular path within said receptacle;

means defining a swimming space that lies essentially along a diameter of said receptacle, said swimming space having water inlet means at one end thereof and water outlet means at the other end thereof;

blade rotating means including a camming structure operable as each blade passes said water outlet means for adjustably moving said blade toward a position transverse to said circular path, and operable as each blade passes said water inlet means for adjustably moving said blade toward a position essentially aligned with said circular path; and diverter means associated with said water inlet means for diverting water from said receptacle into said swimming space, comprising a vertical wall which is curved in the horizontal plane to smoothly direct the water flowing along said circular path within said receptacle so as to enter said diametrically positioned swimming space, and said wall having a vertical slot therein through which each of said blades may pass after it has been rotated into a position of essential alignment with said circular path.

6. A swim-in-place pool comprising:

means forming horizontal inner and outer circulating waterways arranged in such manner that a portion of said inner waterway coincides with a portion of said outer waterway, and the non-coincident portion of said inner waterway provides a swimming space;

a plurality of impeller blades suspended in a spaced series within the coinciding portion of said two waterways, each of said blades being adjustable by rotation about a vertical axis and normally extending transversely of said waterway portion and occupying substantially all of the cross-sectional area thereof;

powered means for advancing said blades in unison along said coinciding portion of said two waterways so that a substantially fixed body of water is captured between each two adjacent blades and advanced therewith; and diverter means adjacent the entry of the non-coincident portion of said inner waterway comprising a vertical wall curved in the horizontal plane for diverting water flowing along the coincident portion of said waterways and smoothly directing it so as to enter said swimming space to thereby provide a continuous flow of water in a relatively non-turbulent state through said swimming space; and said wall having a vertical slot therein through which each of said blades may pass after it has been rotated into a position of essential alignment with the longitudinal axis of said outer waterway.

* * * * *